US006012793A

United States Patent [19]

Haigo

[11] Patent Number: 6,012,793

[45] Date of Patent: Jan. 11, 2000

[54] INK CARTRIDGE AND INK JET PRINTER THAT DETECTS INK DEPLETION

[75] Inventor: Hideaki Haigo, Nagoya, Japan

[73] Assignee: Brother Kogyo Kabushiki Kaisha, Nagoya, Japan

[21] Appl. No.: 08/780,158

[22] Filed: Dec. 26, 1996

[30] Foreign Application Priority Data

Jan. 22, 1996 [JP] Japan ..... 8-028446

[51] Int. Cl.[7] ..... B41J 2/195; B41J 2/175

[52] U.S. Cl. ..... 347/7; 347/86

[58] Field of Search ..... 347/7, 85–87; 73/290 R, 304 R

[56] References Cited

U.S. PATENT DOCUMENTS 4,940,997 7/1990 Hamlin et al. ..... 347/87
5,255,019 10/1993 Mochizuki et al. ..... 347/7
5,341,161 8/1994 Yamakawa et al. ..... 347/87
5,619,238 4/1997 Higuma et al. ..... 347/86
5,657,058 8/1997 Mochizuki et al. ..... 347/7

*Primary Examiner*—John Barlow
*Assistant Examiner*—Craig A. Hallacher
*Attorney, Agent, or Firm*—Oliff & Berridge, PLC

[57] ABSTRACT

An ink cartridge is designed with a reduced number of component parts without deteriorating functions to prevent ink leakage and to detect ink depletion. The ink cartridge has an ink chamber including a foam holding chamber for holding a foam member saturated with ink to be supplied to the print heads and an ink holding chamber for holding ink to be supplied to the foam member. The ink chamber has ink filler ports for filling the ink chamber with ink and electrically conductive plug members, which are exposed to the ink chamber. The plug members close the ink filler ports and detect ink depletion in the ink chamber based on changes in electrical resistance between the plug members.

19 Claims, 8 Drawing Sheets

INK CARTRIDGE AND INK JET PRINTER THAT DETECTS INK DEPLETION

BACKGROUND OF THE INVENTION

1. Field of the Invention

The present invention relates to an ink cartridge, which contains ink, and an ink jet printer for printing by jetting the ink from the ink cartridge onto recording paper.

2. Description of Related Art

A communicating system such as a facsimile system and an information processing system such as a personal computer are usually connected with a printer that is capable of printing data including characters and graphics onto recording paper as visual information. Various printing systems, such as an impact system, a thermosensitive system and an ink jet system, are used for recording. In recent years there has been in widespread use an ink jet printer that uses the ink jet system capable of achieving quiet printing on recording papers produced of various kinds of materials.

The ink jet printer described above is designed to achieve printing onto the entire surface of recording paper. The printing process includes repeatedly printing one band of characters by emitting ink supplied from an ink cartridge to a print head on the recording paper while traversing the print head in a main scanning direction and then moving the recording paper in the direction of sub-scanning for one band width. In this type of ink jet printer, which makes the above-described operation for printing, the ink cartridge is filled with a piece of foam soaked with the ink in order to obtain good printing quality with insured stabilized ink supply to the print head. Further, an ink sensor is employed to detect the presence or absence of the ink for the purpose of predetecting ink depletion in order to prevent defective printing.

That is, in a prior art ink cartridge 51 shown in FIG. 1, an air communicating port 51B and an ink filler port 51C are formed in the top and bottom walls respectively. An electrode 54 is installed as an ink sensor in a space 53 defined by a rib 51A between a wall surface of the ink cartridge 51 and a foam 52. Ink is charged to the foam 52 and the space 53 in the ink cartridge 51 through the ink filler port 51C. By this, the ink supply from the foam 52 is stabilized and ink depletion can be detected with the electrode 54.

In the prior art design described above, however, it becomes necessary to close the ink filler port 51C by a plug member 55 to prevent ink leakage from the ink filler port 51C after the ink is filled in the ink cartridge 51. To reduce the total manufacturing cost, it is desirable to decrease the number of component parts by removing the plug member 55 and the electrode 54 without adversely affecting such functions as the prevention of ink leakage and the detection of ink depletion.

SUMMARY OF THE INVENTION

It is, therefore, an object of the present invention to provide an ink cartridge and an ink jet printer that can reduce the number of component parts without deteriorating functions such as the prevention of ink leakage and the detection of ink depletion.

To solve the aforementioned and other problems, an ink cartridge of the present invention is provided with an ink chamber for holding ink to be supplied to an ink jet head, an ink filler port for filling the ink in the ink chamber, and a plug member for closing the ink filler port while being exposed into the ink chamber and having electrical conductivity for detecting ink depletion in the ink chamber. Since the plug member is used for both closing the ink filler port and detecting ink depletion in the ink chamber, it is possible to decrease the number of component parts and reduce the production cost, as compared with the prior art ink cartridge that has an electrode for detecting ink depletion separately from the plug member.

In the ink cartridge of the present invention, the plug member may be a metal ball. The direction of insertion of this ball plug member in the ink supply port is not limited, thereby facilitating closing of the ink filler port.

Furthermore, in the ink cartridge of the present invention, the ink chamber may be formed as a foam holding chamber for holding an ink-soaked porous member and an ink holding chamber that communicates with the foam holding chamber and holds ink alone. The ink filler port may be formed in both the foam holding chamber and the ink holding chamber. The above-described design allows simultaneous filling of ink in both the ink holding chamber and the foam holding chamber. Therefore, ink filling can be completed in a short time.

Furthermore, the ink cartridge of the present invention may be so designed as to be removable in relation to the ink jet head. Accordingly, since only the ink cartridge is replaced, maintenance cost required for cartridge replacement in case of ink depletion can be reduced.

Furthermore, an ink jet printer of the present invention is provided with the ink cartridge, a holding member for holding the ink cartridge, a connecting section mounted on the holding member and electrically connectable to the plug member of the ink cartridge, and a detection device, which receives an electrical signal from the plug member via the connecting section and detects ink depletion in the ink cartridge. According to the provisions of the aforesaid design, it is possible to obtain an ink jet printer capable of accurately detecting ink depletion in the ink cartridge based on the detecting device detecting an electrical signal from the plug member exposed to the ink holding chamber.

BRIEF DESCRIPTION OF THE DRAWINGS

Preferred embodiments of the present invention will be described in detail with reference to the following figures wherein.

DETAILED DESCRIPTION OF PREFERRED EMBODIMENTS

An embodiment of the present invention will be described with reference to FIGS. 2 to 9.

Figure 3:
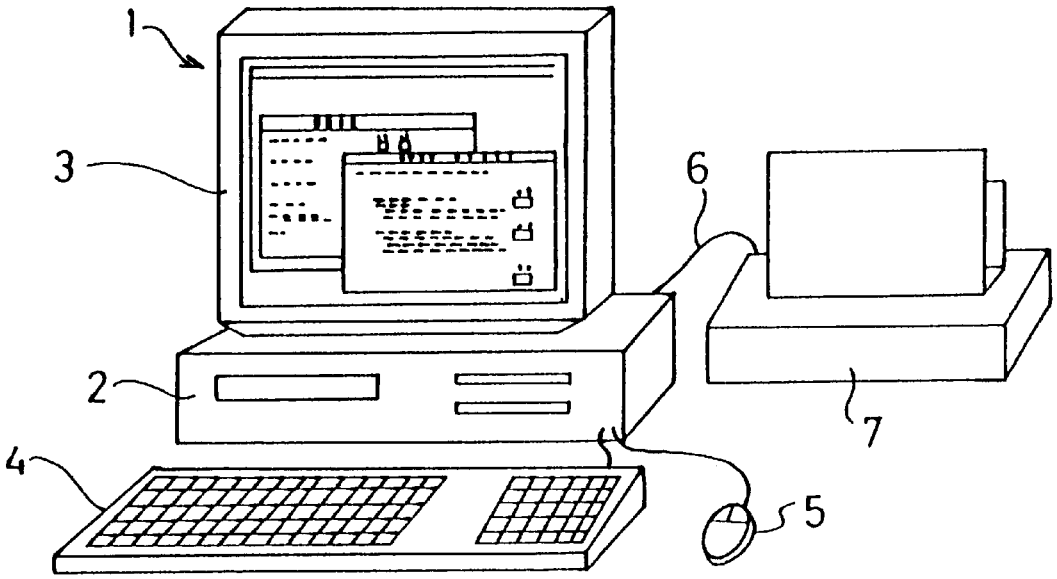
FIG. 3 is a perspective view of an ink jet printer connected to an information processor.

An ink jet printer of the present embodiment, as shown in FIG. 3, is connected to an information processor 1, such as a personal computer. The information processor 1 has a processor body 2 incorporating an auxiliary memory device, such as a magnetic disk device, and a central processing unit. A CRT (cathode-ray tube) 3 is used to present data on a screen, and a keyboard 4 and a mouse 5 are used for inputting and indicating data. The information processor 1 is connected to a printer 7, which is the ink jet printer, through a printer cable 6 having, for example, Centronics specifications.

Figure 4:
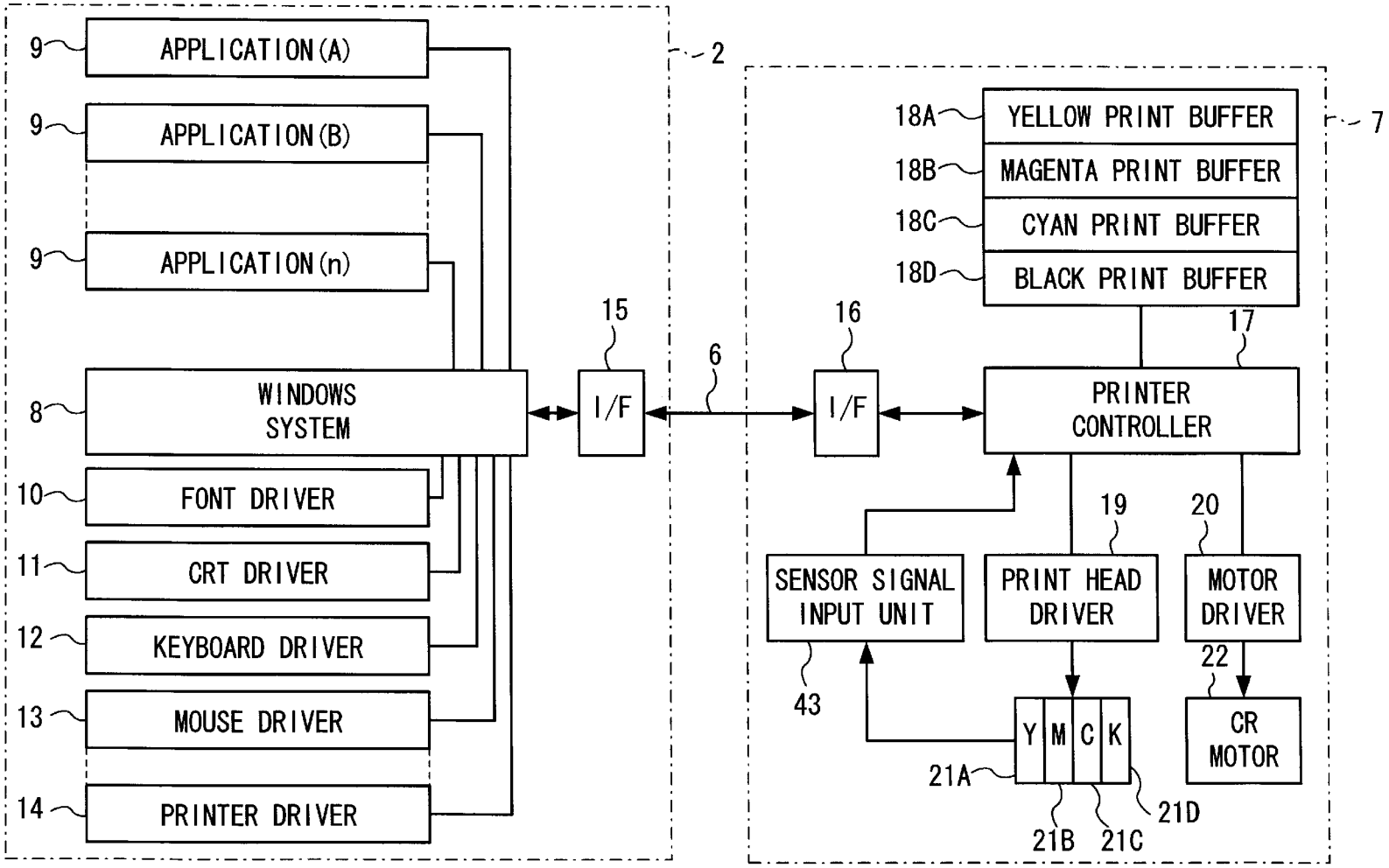
FIG. 4 is a block diagram of the information processor and the ink jet printer.

The processor body 2 mentioned above is provided with, for example, a windows system 8 as an operating system (OS) as shown in FIG. 4. The windows system 8 is so designed as to execute one or more applications 9 simultaneously in cooperation with various kinds of function groups, such as the applications 9 for document preparation programs, a font driver 10 for controlling the font of characters, a CRT driver 11 for controlling the CRT 3, a keyboard driver 12 for controlling the keyboard 4, a mouse driver 13 for controlling the mouse 5, and a printer driver 14 for controlling the printer 7. Of course, any type of information processing device, including but not limited to a notebook or a facsimile machine, can be used with this printing assembly.

The above-described printer driver 14 is capable of forming dot image data in a preselected color printing or monochromatic printing mode when, for example, a "Print" menu has been selected for data displayed on the screen of the CRT 3. For example, in the case of the color printing mode, four-color dot image data (pixel data arranged horizontally and vertically in a dot matrix array) of yellow (Y), magenta (M), cyan (C) and black (K) are formed on the basis of font data of a text to be printed, and such pixel data as graphical and pictorial images. These dot image data are outputted in order from an interface (I/F) unit 15 as print data of 8-bit unit in the horizontal direction (raster direction) per raster.

Figure 1:
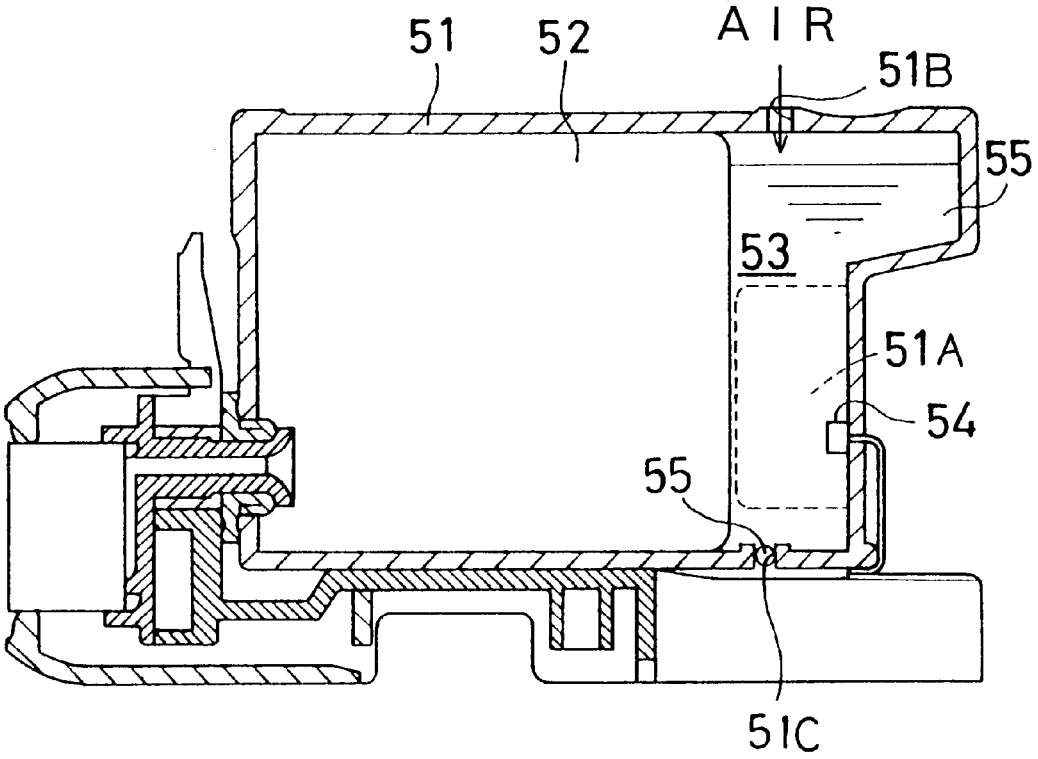
Fig.1 PRIOR ART
FIG. 1 is a sectional view of a prior art ink cartridge.
Figure 2:
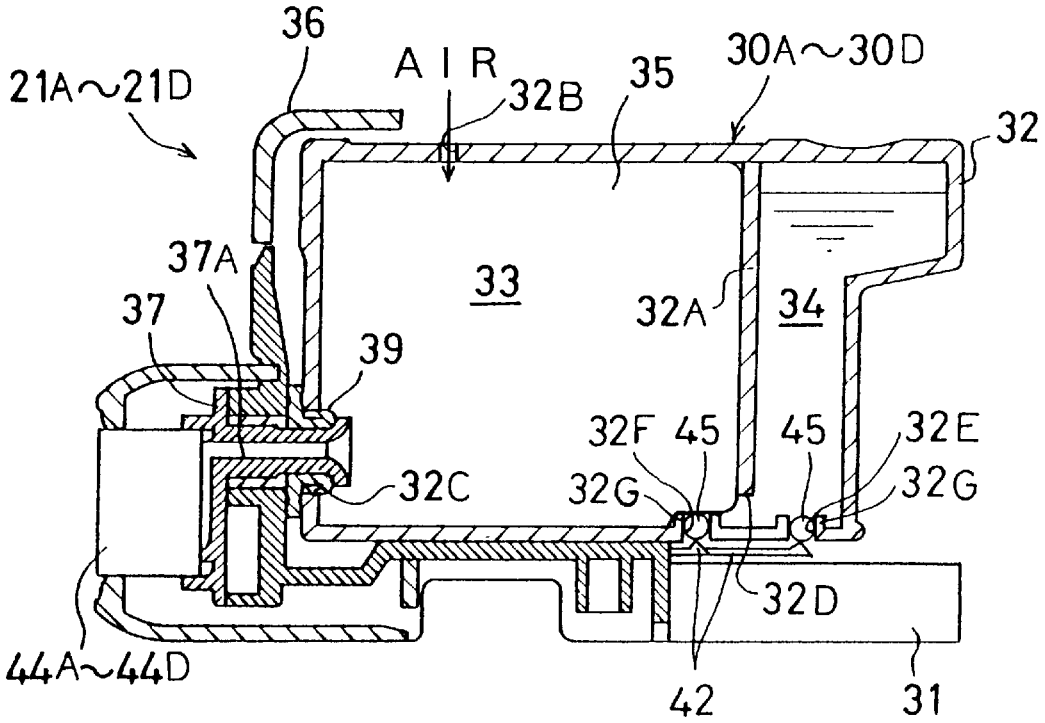
FIG. 2 is a sectional view showing an ink cartridge mounted to a cartridge holding member.

The print data that has been outputted in the raster scan mode is inputted into an I/F (interface) unit 16 of the printer 7. The printer 7 has a printer controller 17, print buffers 18A to 18D for storing print data of yellow (Y), magenta (M), cyan (C) and black (K) respectively, a print head drive unit 19, a CR motor drive unit 20, and a sensor signal input unit 43. The CR motor drive unit 20 is connected to a CR motor 22 to turn the CR motor 22 in normal and reverse directions. In the meantime, the print head drive unit 19 is connected to yellow (Y), magenta (M), cyan (C) and black (K) print head mechanisms 21A to 21D. These print head mechanisms 21A to 21D have print heads 44A to 44D (ink jet heads), in which, as shown in FIG. 2, ink nozzles that jet ink by utilizing the displacement of piezoelectric elements are arranged in the direction of sub-scanning, for example for 64 channels. A driving voltage is applied from the print head drive unit 19 shown in FIG. 4 to the piezoelectric elements of the nozzles of the print heads 44A to 44D, thereby displacing the piezoelectric elements.

Figure 5:
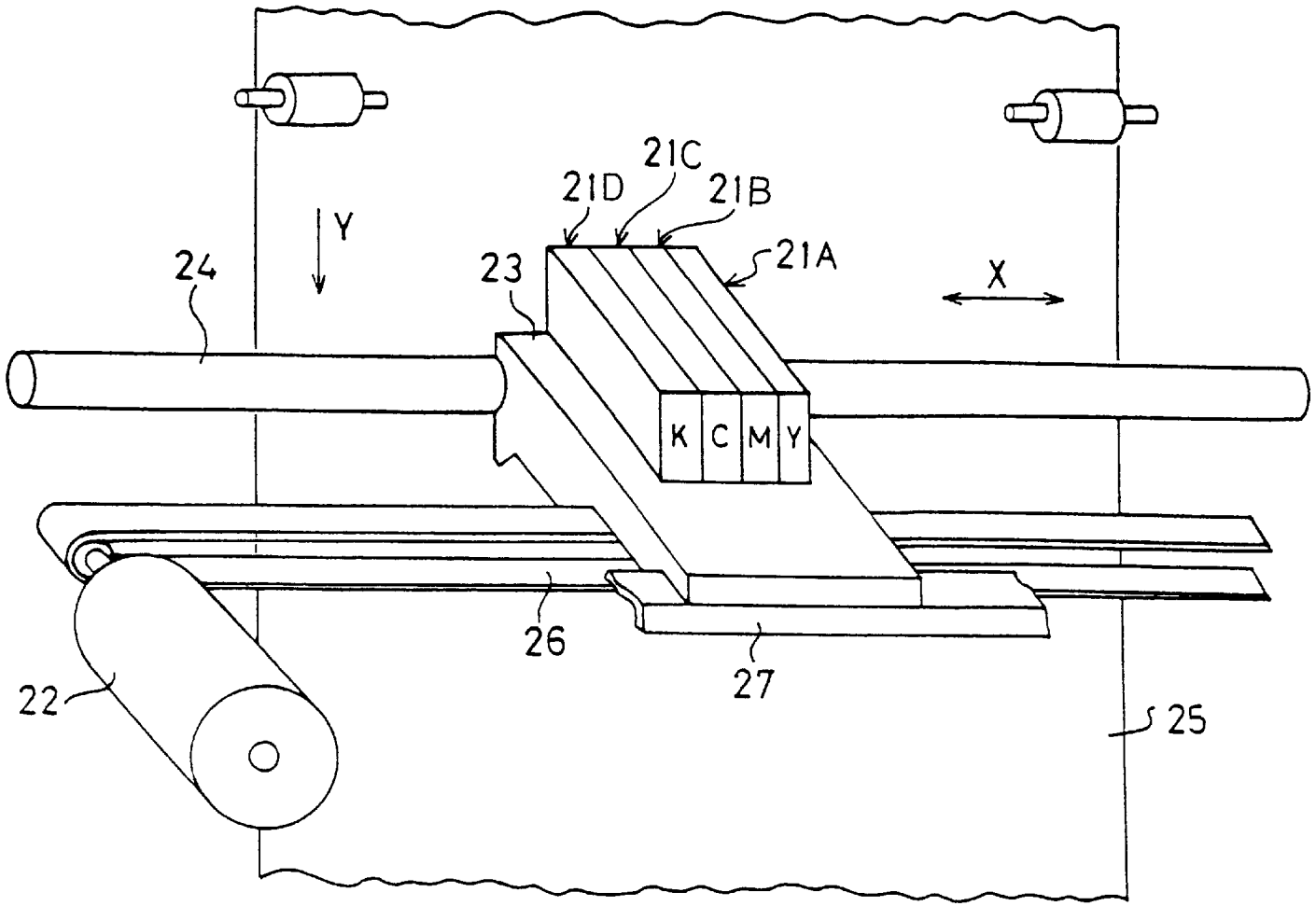
FIG. 5 is a perspective view showing a major portion of the ink jet printer.

The print head mechanisms 21A to 21D, as shown in FIG. 5, are arranged in the direction of main scanning X and are secured to a carriage 23 in such a manner that the ink will be emitted to recording paper 25 at a predetermined angle. The carriage 23 is movably supported on a guide shaft 24 and a guide plate 27 laterally mounted in the main scanning direction X and is connected to a scanning belt 26 driven by the CR motor 22. The CR motor 22 for driving the scanning belt 26 reciprocates the carriage 23 in the main scanning direction X along the guide shaft 24. Moving for main scanning, the print head mechanisms 21A to 21D are moved while keeping a constant distance between the print head mechanism 21A to 21D and the recording paper 25.

Figure 6:
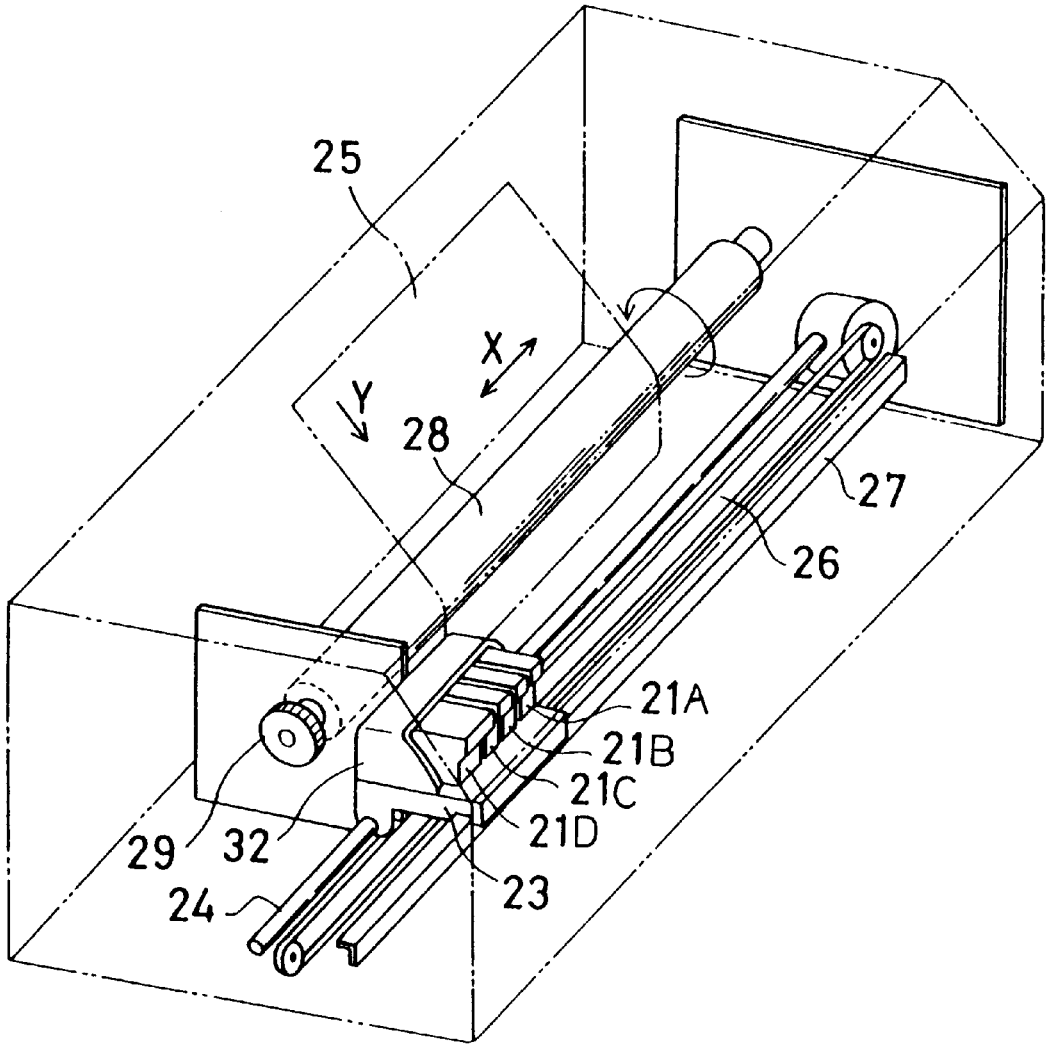
FIG. 6 is a perspective view showing a major portion of the ink jet printer.
Figure 7:
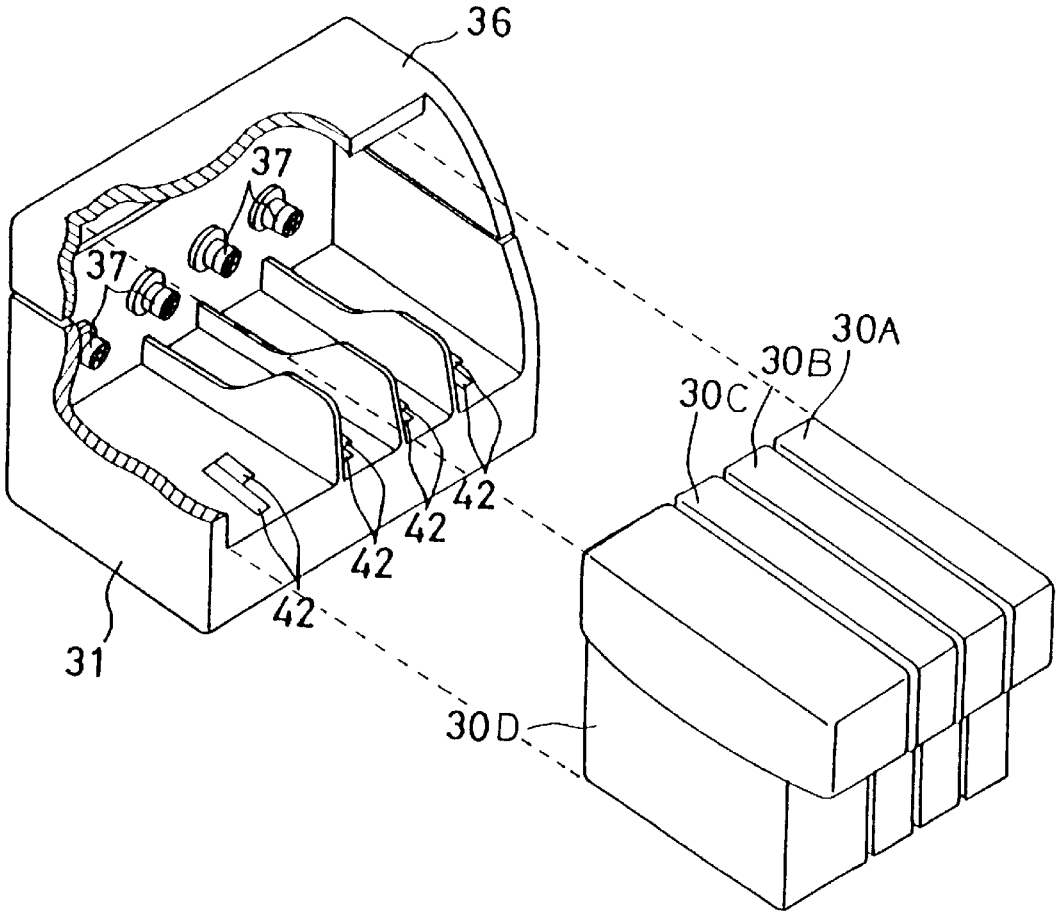
FIG. 7 is a cut-away exploded view showing the ink cartridge mounted to the cartridge holding member.

The recording paper 25 facing the print head mechanisms 21A to 21D is supported on a platen roller 28 as shown in FIG. 6. The platen roller 28 is mounted in parallel with the guide shaft 24, and is rotatably supported at its both ends. On one end of the platen roller 28 is mounted a roller gear 29. The roller gear 29 is engaged with a motor gear, which is secured to an unillustrated paper feed motor. The paper feed motor rotates the platen roller 28 through the roller gear 29, thereby moving the recording paper 25 in the direction of sub-scanning Y. The movement of the recording paper 25 in the sub-scanning direction Y is repeated every time printing is done for one band by making the main scanning by the print head mechanisms 21A to 21D.

Figure 8:
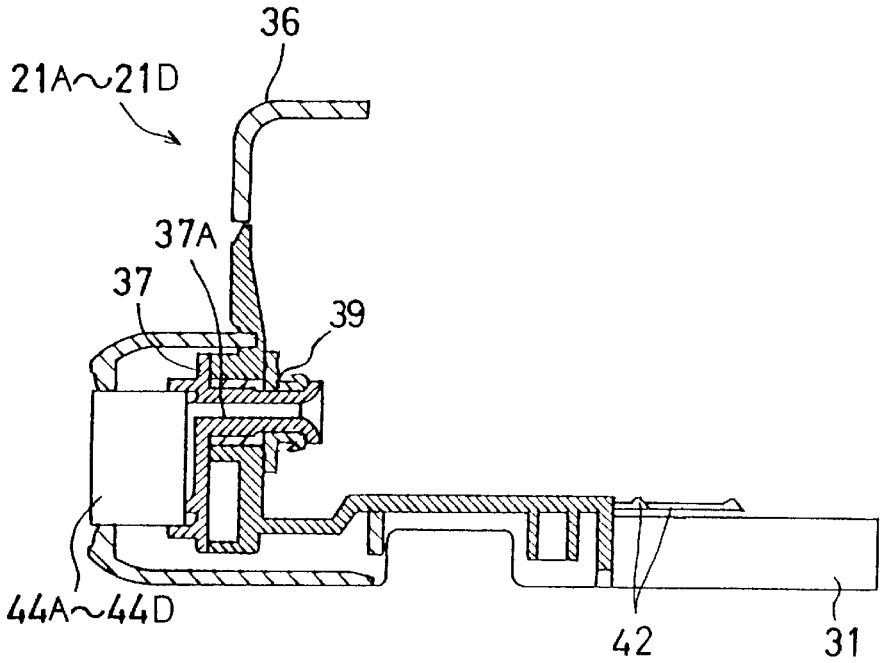
FIG. 8 is a sectional view of the cartridge holding member.
Figure 9:
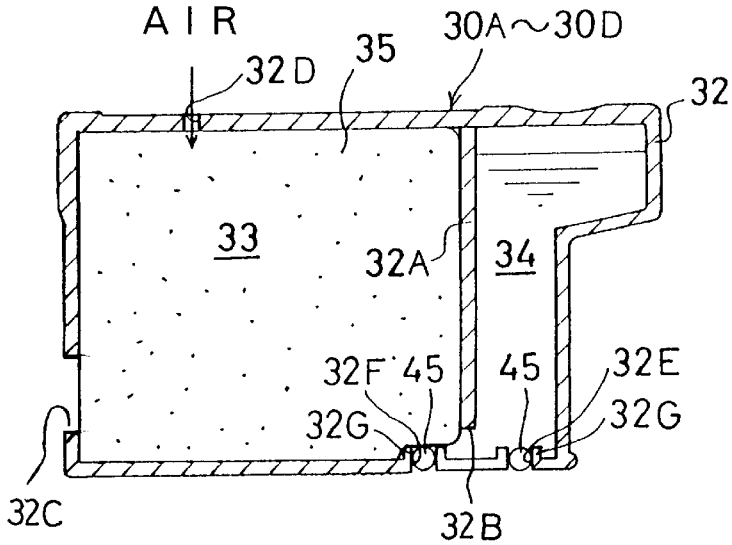
FIG. 9 is a sectional view of the ink cartridge.

The print head mechanisms 21A to 21D described above, as shown in FIG. 7, have a cover member 36 and cartridge holding member 31, ink supply members 37 mounted on the cartridge holding member 31, and ink cartridges 30A to 30D removably mounted on the cartridge holding member 31. FIG. 8 is a sectional view of the cartridge holding member 31, and FIG. 9 is a sectional view showing the ink cartridges 30A to 30D. As shown in FIG. 8, the aforesaid print heads 44A to 44D are held at the front of the ink supply members 37. The ink cartridges 30A to 30D removably mounted on the cartridge holding member 31 are removably mounted to the print heads 44A to 44D. The sectional view of FIG. 9 shows the ink cartridges 30A to 30D as removed from the cartridge holding member 31.

Each of the ink cartridges 30A to 30D shown in FIG. 9 has a hollow cartridge body 32. In the cartridge body 32, there is a partition wall 32A, forming a communicating passage 32B in its lower part. The partition wall 32A forms an ink chamber comprising a foam holding chamber 33 and an ink holding chamber 34, which communicate in their lower part.

The foam holding chamber 33 is filled with a piece of foam 35 (any type of porous member) having continuous foam suitable for ink impregnation. In the lower part of a side wall of the cartridge body 32, which forms the foam holding chamber 33, an ink supply port 32C is formed.

As shown in FIG. 2, in the ink supply port 32C, the above-described ink supply member 37 is fitted in a liquid tight manner through a seal member 39. The ink supply member 37 is formed with an ink passage 37A, which connects the print heads 44A to 44D to the foam holding chambers 33. The ink passage 37A is designed to supply the ink to all the channels of the print heads 44A to 44D from the ink supply member 37. In the top wall of the cartridge body 32, which forms the foam holding chamber 33, an air hole 32D is formed open to the atmosphere. The air hole 32D is designed to supply the same amount of air as the amount of ink consumed into the foam holding chamber 33. Further, in the bottom wall of the cartridge body 32 there is an ink filler port 32F having a projecting portion or inwardly protruding lip 32G therearound set at a predetermined level. The ink filler port 32F is used when filling the foam holding chamber 33 with ink.

In the meantime, the ink holding chamber 34 holds only the ink. In the bottom wall of the cartridge body 32, which forms the ink holding chamber 34, an ink filler port 32E is formed similarly to the above-mentioned ink filler port 32F. The ink filler port 32E is used when filling ink in the ink holding chamber 34.

In the ink filler ports 32E and 32F, plug members 45, 45 comprising an electrically conductive metal ball are fitted in a liquid-tight manner for the purpose of preventing ink leakage and to serve as electrodes. These plug members 45, 45 are held in contact with electrode terminals 42, 42 (which function as connecting sections) provided on the cartridge holding member 31. The electrode terminals 42, 42 are connected to the sensor signal input unit 43 as shown in FIG. 4. The sensor signal input unit 43 serves to detect electrical resistance between the electrode terminals 42, 42 (the plug members 45, 45), and output a value of detected resistance to the printer controller 17, thereby detecting ink depletion by the printer controller 17. The aforementioned plug members 45, 45 are not limited to a metal ball and may be, for example, a conductive metal bar or plate or conductive resin.

Operation of the ink jet printer of the above-described design is described below. First, in filling the cartridge body 32 with ink, an unillustrated known vacuum impregnating machine is used.

As shown in FIG. 9, after the foam 35 is filled in the foam holding chamber 33 of the cartridge body 32, the air will be removed by evacuation from the cartridge body 32 (specifically, the ink chamber including the foam holding chamber 33 and the ink holding chamber 34). Thereafter, ink is charged into the foam holding chamber 33 and the ink holding chamber 34 through the ink filler ports 32E and 32F.

After the completion of ink filling by the vacuum impregnating machine, the ink filler ports 32E and 32F are closed tightly with the plug members 45, 45. Then, the ink cartridges 30A to 30D thus charged with ink are mounted to the cartridge holding member 31 with the ink supply members 37 fitted in the ink supply ports 32C. After mounting the ink cartridges 30A to 30D to the cartridge holding member 31, the plug members 45, 45 fitted in the ink filler ports 32E and 32F located in the bottom of the cartridge body 32 contact with the electrode terminals 42, 42 mounted on the cartridge holding member 31. Thus the plug members 45, 45 are electrically connected to the sensor signal input unit 43 of FIG. 4 via the electrode terminals 42, 42. Because the plug members 45, 45 are conductive metal balls, electrical resistance between the plug members 45, 45 will be detected by means of the sensor signal input unit 43 as shown in FIG. 4. Then, the value of electrical resistance thus detected will be read by the printer controller 17, to thereby determine ink depletion, or not.

That is, during the initial period after mounting the ink cartridges 30A to 30D to the cartridge holding member 31, the ink holding chamber 34 is full of ink and the plug members 45, 45 are covered with the ink. In this state, there exists little electrical resistance between the plug members 45, 45 due to the conductive ink. The printer controller 17, therefore, obtains the comparison result that the electric resistance value is under a predetermined value, thus determining the presence of ink.

Next, the print head mechanisms 21A to 21D are driven by the print head drive unit 19 as shown in FIG. 2, and ink is jetted from the print heads 44A to 44D, to thereby perform printing for one band. Then the ink soaked in the foam 35 in the foam holding chamber 33 is supplied to the print heads 44A to 44D that have been evacuated, through the ink supply members 37. At the same time, the same amount of air as the amount of ink consumed from the foam holding chamber 33 is taken in through the air hole 32D. The air hole 32D is formed in the cartridge body 32 forming the foam holding chamber 33, preferentially supplying air to the foam holding chamber 33. The ink in the foam holding chamber 33, therefore, is consumed preferentially. When the ink level has reached the communicating passage 32B located below the bottom end of the partition wall 32A as a result of continued printing, consumption of the ink in the ink holding chamber 34 will be started.

Thereafter, when the ink level in the ink holding chamber 34 has gone down below the top end of the projecting portions 32G, 32G, there is no electrical contact between the plug members 45, 45. Therefore, the electrical resistance between the plug members 45, 45 will increase. The printer controller 17 obtains a comparison result that the electrical resistance value is over a predetermined value. The printer controller 17 detects ink depletion and indicates the ink depletion on the screen of an unillustrated display and, at the same time, indicates the same on the screen of the CRT 3 of FIG. 3.

Having described the specific preferred embodiment of the invention with reference to the accompanying drawings, it will be appreciated that the present invention is not limited to the described embodiment.

Various changes and modifications can be effected therein by one of ordinary skill in the art without departing from the scope and spirit of the invention as defined by the appended claims.

What is claimed is:

1. An ink cartridge assembly for use with an ink printer having an ink cartridge receiving structure and a circuit for detecting ink depletion, including:

an ink cartridge comprising:

a hollow body defining an ink chamber, the ink chamber storing ink and having an ink supply port and an ink filler port; and a conductive plug member sealingly engaged in the ink filler port;

wherein, when the ink cartridge assembly is positioned within the ink cartridge receiving structure, the conductive plug member is connected to a terminal of the circuit to be an ink depletion electrode in the ink chamber.

2. The ink cartridge assembly of claim 1 wherein the hollow body has a partition wall extending therein that divides the ink chamber into a foam holding chamber and an ink holding chamber, the foam holding chamber and the ink holding chamber being in fluid communication with each other.

3. The ink cartridge assembly of claim 2 further comprising an ink impregnable porous member positioned in the foam holding chamber.

4. The ink cartridge assembly of claim 2 wherein the ink supply port is formed in the foam holding chamber and wherein the foam holding chamber also has an air hole by which atmospheric air can communicate with the foam holding chamber.

5. The ink cartridge assembly of claim 1 further comprising a pair of ink filler ports, each ink filler port having a conductive plug member engaged therein.

6. The ink cartridge assembly of claim 5 further comprising conductive ink disposed in the ink chamber, wherein the conductive ink forms an electrical connection between the pair of conductive plug members when the ink chamber has a predetermined amount of ink therein and wherein the electrical connection is broken when the ink chamber has less than the predetermined amount of ink therein thereby indicating ink depletion.

7. The ink cartridge assembly of claim 1 wherein the ink filler port has a lip that projects into the ink chamber.

8. The ink cartridge assembly of claim 1 wherein the plug member comprises a metal ball.

9. The ink cartridge assembly of claim 1 further comprising an ink cartridge holding member that supports that ink cartridge and has an electrode terminal thereon, wherein the conductive plug member electrically connects with the electrode terminal to signal ink depletion in the ink chamber.

10. The ink cartridge assembly of clam 1 further comprising a plurality of ink cartridges assembled as a modular unit.

11. An ink printing assembly, comprising:

a print head mechanism that applies ink onto a substrate;

an ink cartridge assembly coupled to the print head mechanism that supplies ink to the print head mechanism, the ink cartridge assembly including:

an ink cartridge having a hollow body defining an ink chamber, the ink chamber storing ink and having an ink supply port and an ink filler port; and a conductive plug member sealingly engaged in the ink filler port;

a controller coupled to the print head mechanism and the ink cartridge assembly that controls the print head mechanism to print based on print data and receives signals from the ink cartridge assembly when ink depletion is detected in the ink cartridge; and an ink cartridge holding member that supports the ink cartridge and couples the print head to the ink cartridge, the ink cartridge holding member having a terminal that electrically connects the conductive plug member to the controller, the conductive plug member forming an ink depletion electrode within the ink chamber of an ink depletion circuit.

12. The ink jet printing assembly of claim 11 wherein the hollow body of the ink cartridge has a partition wall extending therein that divides the ink chamber into a foam holding chamber that holds an ink impregnable porous member therein and an ink holding chamber, the foam holding chamber and the ink holding chamber being in fluid communication with each other.

13. The ink jet printing assembly of claim 11 further comprising a pair of ink filler ports, each ink filler port having a conductive plug member engaged therein.

14. The ink jet printing assembly of claim 13 wherein one of the ink filler ports is positioned in each of the foam holding chamber and the ink holding chamber.

15. The ink jet printing assembly of claim 14 further comprising conductive ink disposed in the ink chamber, wherein the conductive ink forms an electrical connection between the pair of conductive plug members when the ink chamber has a predetermined amount of ink therein and wherein the electrical connection is broken when the ink chamber has less than the predetermined amount of ink therein thereby indicating ink depletion.

16. The ink jet printing assembly of claim 15 wherein the ink cartridge assembly further comprises an ink cartridge holding member that supports the ink cartridge and couples the print head to the ink cartridge, the ink cartridge holding member having a pair of electrode terminals that are connected to the controller, wherein the conductive plug members electrically connect with the electrode terminals to signal the controller when ink is depleted in the ink chamber.

17. The ink jet printing assembly of claim 16 wherein the controller measures resistance between the conductive plug members to detect depletion of ink in the ink chamber.

18. The ink jet printing assembly of claim 11 wherein the ink filler port has a lip that projects into the ink chamber and the conductive plug member is seated flush with the lip.

19. The ink jet printing assembly of claim 11 wherein the plug member comprises a metal ball.

* * * * *